US006811500B2

(12) United States Patent
Tien

(10) Patent No.: US 6,811,500 B2
(45) Date of Patent: Nov. 2, 2004

(54) BASKETBALL PRACTICING AND COLLECTING DEVICE

(76) Inventor: Feng-Yi Tien, 58, Ma Yuan West St., Taichung (TW)

( * ) Notice: Subject to any disclaimer, the term of this patent is extended or adjusted under 35 U.S.C. 154(b) by 37 days.

(21) Appl. No.: 10/370,319

(22) Filed: Feb. 13, 2003

(65) Prior Publication Data

US 2004/0162165 A1 Aug. 19, 2004

(51) Int. Cl.[7] ..... A63B 69/00
(52) U.S. Cl. ..... 473/433
(58) Field of Search ..... 473/433, 432, 473/431, 422, 472, 479, 481, 483, 484; 273/317.3

(56) References Cited

U.S. PATENT DOCUMENTS 5,035,423 A * 7/1991 Arciniega ..... 473/433
5,165,680 A * 11/1992 Cass ..... 473/433
5,171,009 A * 12/1992 Filewich et al. ..... 473/433
5,330,175 A * 7/1994 Kim ..... 273/397
5,364,091 A * 11/1994 Sebek ..... 473/433
5,800,295 A * 9/1998 Rogitz ..... 473/483

* cited by examiner

*Primary Examiner*—Stephen P. Garbe
*Assistant Examiner*—M. Chambers

(57) ABSTRACT

A basketball practicing and collecting device includes a base, a first tube, a lift tube, a second tube, a third tube, a lower support rack, a backboard, a reduction motor, a drive roller, a driven roller, a frame tube, two opposite pulley members, two opposite slide seats, a pull handle, and a pull cord. Thus, the frame tube can be turned horizontally, while the ball inlet opening and the collection channel are moved and directed toward the same direction, so that the basketball falling into the elastic net from the ball inlet opening can be collected and introduced outward through the collection channel, thereby facilitating the user practicing the free throw in a determined direction.

18 Claims, 7 Drawing Sheets

BASKETBALL PRACTICING AND COLLECTING DEVICE

BACKGROUND OF THE INVENTION

1. Field of the Invention

The present invention relates to a basketball practicing and collecting device, and more particularly to a basketball practicing and collecting device including a frame tube that can be turned horizontally, so that the user can practice the free throw in a determined direction.

2. Description of the Related Art

Usually, when a single person is practicing the basketball, he can face the backboard to practice the free throw. However, the exerciser cannot control the direction of the bouncing basketball, so that the basketball easily jumps far away irregularly, and the exerciser has to spend much time to pick up the basketball bouncing far away, thereby wasting a great of time for picking up the basketball, and thereby greatly reducing the exerciser's interest.

SUMMARY OF THE INVENTION

The primary objective of the present invention is to provide a basketball practicing and collecting device including a frame tube that can be turned horizontally, so that the user can practice the free throw in a determined direction.

Another objective of the present invention is to provide a basketball practicing and collecting device, wherein when the frame tube is turned horizontally, the ball inlet opening and the collection channel are moved and directed toward the same direction, so that the basketball falling into the elastic net from the ball inlet opening can be collected and introduced outward through the collection channel, thereby facilitating the user practicing the free throw in a determined direction.

In accordance with the present invention, there is provided a basketball practicing and collecting device, comprising a base, a first tube, a lift tube, a second tube, and a third tube, wherein:

the first tube has a lower end secured on the base;

the lift tube has a lower end retractably mounted on an upper end of the first tube;

the second tube has a lower end retractably mounted on an upper end of the lift tube;

the third tube has a lower end mounted on an upper end of the second tube;

the basketball practicing and collecting device further comprises a lower support rack having a first end secured on an upper end of the third tube and a second end secured on a lower end of the backside of the backboard;

the basketball practicing and collecting device further comprises a reduction motor secured on the lower support rack, a drive roller mounted on and rotated by the reduction motor, a driven roller secured on the lower support rack and located adjacent to the drive roller, and a frame tube urged between the drive roller and the driven roller;

the second tube is formed with an elongated guide slot, the guide slot of the second tube has a lower end formed with a locking recess vertical to the guide slot;

the third tube has a top formed with a slide hole; and the basketball practicing and collecting device further comprises two opposite pulley members each secured on the upper end of the backside of the backboard, two opposite slide seats each mounted on the frame tube, a pull handle slidably mounted in the guide slot of the second tube, and a pull cord secured on the pull handle and having two ends each extended through the second tube, the third tube, the slide hole and a respective one of the two opposite pulley members, and each secured on a respective one of the two opposite slide seats.

Further benefits and advantages of the present invention will become apparent after a careful reading of the detailed description with appropriate reference to the accompanying drawings.

BRIEF DESCRIPTION OF THE DRAWINGS

FIG. 1A is a partially enlarged view of the basketball practicing and collecting device as shown in FIG. 1;

FIG. 5A is a partially enlarged view of the basketball practicing and collecting device as shown in FIG. 5;

DETAILED DESCRIPTION OF THE INVENTION

Figure 1:
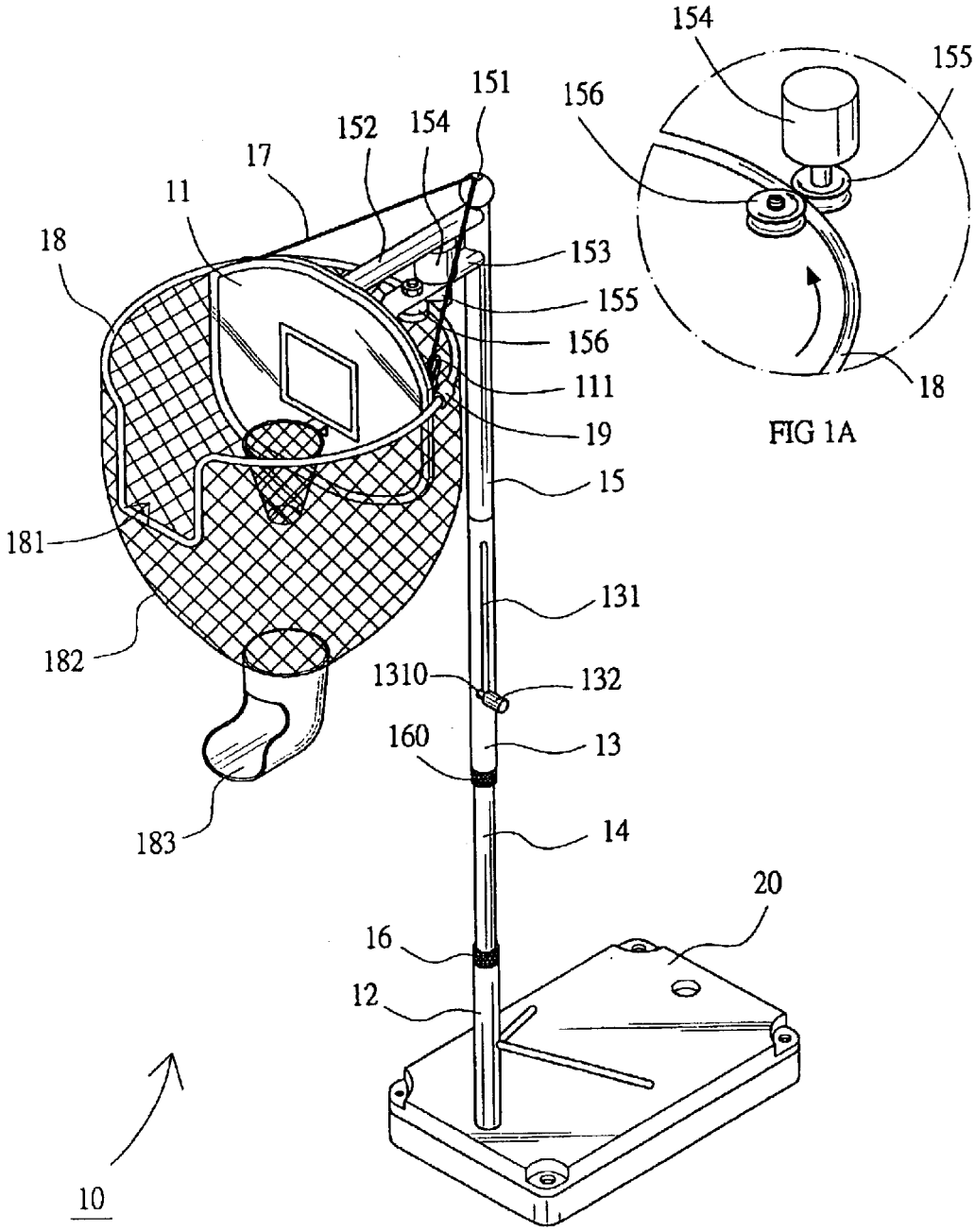
FIG. 1 is a perspective view of a basketball practicing and collecting device in accordance with the preferred embodiment of the present invention.

Referring to the drawings and initially to FIGS. 1–5, a basketball practicing and collecting device 10 in accordance with the preferred embodiment of the present invention comprises a base 20, a first tube 12, a lift tube 14, a second tube 13, and a third tube 15.

The first tube 12 has a lower end secured on the base 20.

The lift tube 14 has a lower end retractably mounted on an upper end of the first tube 12. Preferably, the lower end of the lift tube 14 is mounted on the upper end of the first tube 12 by a first snap ring 16.

The second tube 13 has a lower end retractably mounted on an upper end of the lift tube 14. Preferably, the lower end of the second tube 13 is mounted on the upper end of the lift tube 14 by a second snap ring 160.

The third tube 15 has a lower end mounted on an upper end of the second tube 13.

The basketball practicing and collecting device 10 further comprises an upper support rack 152 having a first end secured on the upper end of the third tube 15 and a second end secured on an upper end of a backside of a backboard 11.

The basketball practicing and collecting device 10 further comprises a lower support rack 153 having a first end secured on the upper end of the third tube 15 and a second end secured on a lower end of the backside of the backboard 11.

The basketball practicing and collecting device 10 further comprises a reduction motor 154 secured on the lower support rack 153, a drive roller 155 made of rubber mounted on and rotated by the reduction motor 154, a driven roller 156 made of rubber secured on the lower support rack 153 and located adjacent to the drive roller 155, and a frame tube 18 urged between the drive roller 155 and the driven roller 156.

The second tube 13 is formed with an elongated guide slot 131. The guide slot 131 of the second tube 13 has a lower end formed with a locking recess 1310 vertical to the guide slot 131. The third tube 15 has a top formed with a slide hole 151. The basketball practicing and collecting device 10 further comprises two opposite pulley members 111 each secured on the upper end of the backside of the backboard 11, two opposite slide seats 19 each mounted on the frame tube 18, a pull handle 132 slidably mounted in the guide slot 131 of the second tube 13, and a pull cord 17 secured on the pull handle 132 and having two ends each extended through the second tube 13, the third tube 15, the slide hole 151 and a respective one of the two opposite pulley members 111, and each secured on a respective one of the two opposite slide seats 19.

In such a manner, when the pull handle 132 is moved downward in the guide slot 131 of the second tube 13 and locked in the locking recess 1310 as shown in FIG. 1, the pull cord 17 is pulled downward by the pull handle 132 to pull the two opposite slide seats 19 upward, thereby pivoting the frame tube 18 upward, so as to stretch the frame tube 18, so that the backboard 11 is compassed in the frame tube 18.

At this time, the drive roller 155 is rotated by the reduction motor 154, and the frame tube 18 is held and urged between the drive roller 155 and the driven roller 156, so that the frame tube 18 is turned horizontally by rotation of the drive roller 155 and the driven roller 156 as shown in FIG. 1A.

The frame tube 18 is a ring-shaped tube, and has a side formed with a ball inlet opening 181 for passage of the basketball. The frame tube 18 has a lower portion provided with an elastic net 182 encompassing the backboard 11. The elastic net 182 has a lower portion provided with a collection channel 183. Thus, the basketball falling into the elastic net 182 can be collected and introduced outward through the collection channel 183.

Figure 2A:
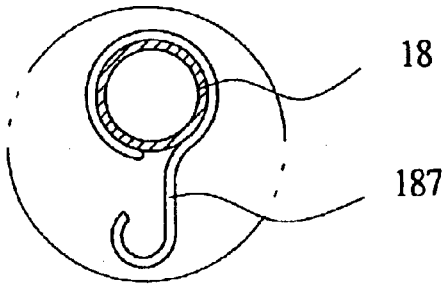
FIG. 2A is a partially enlarged cross-sectional view of the frame tube of the basketball practicing and collecting device as shown in FIG. 2.
Figure 2:
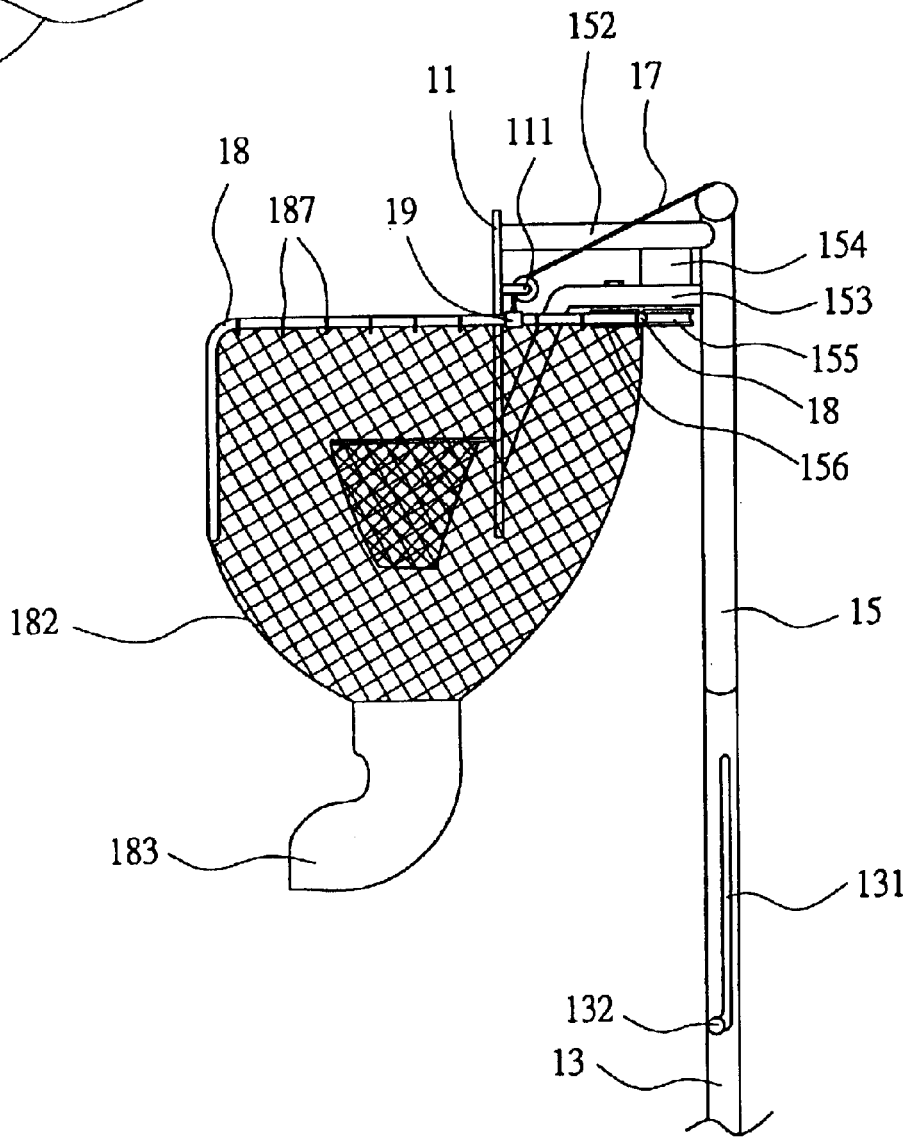
FIG. 2 is a side plan view of the basketball practicing and collecting device as shown in FIG. 1.

As shown in FIGS. 2 and 2A, the frame tube 18 is provided with a plurality of net hooks 187 for hanging the elastic net 182, so that the elastic net 182 can be mounted on and detached from the frame tube 18 easily and conveniently.

Figure 3:
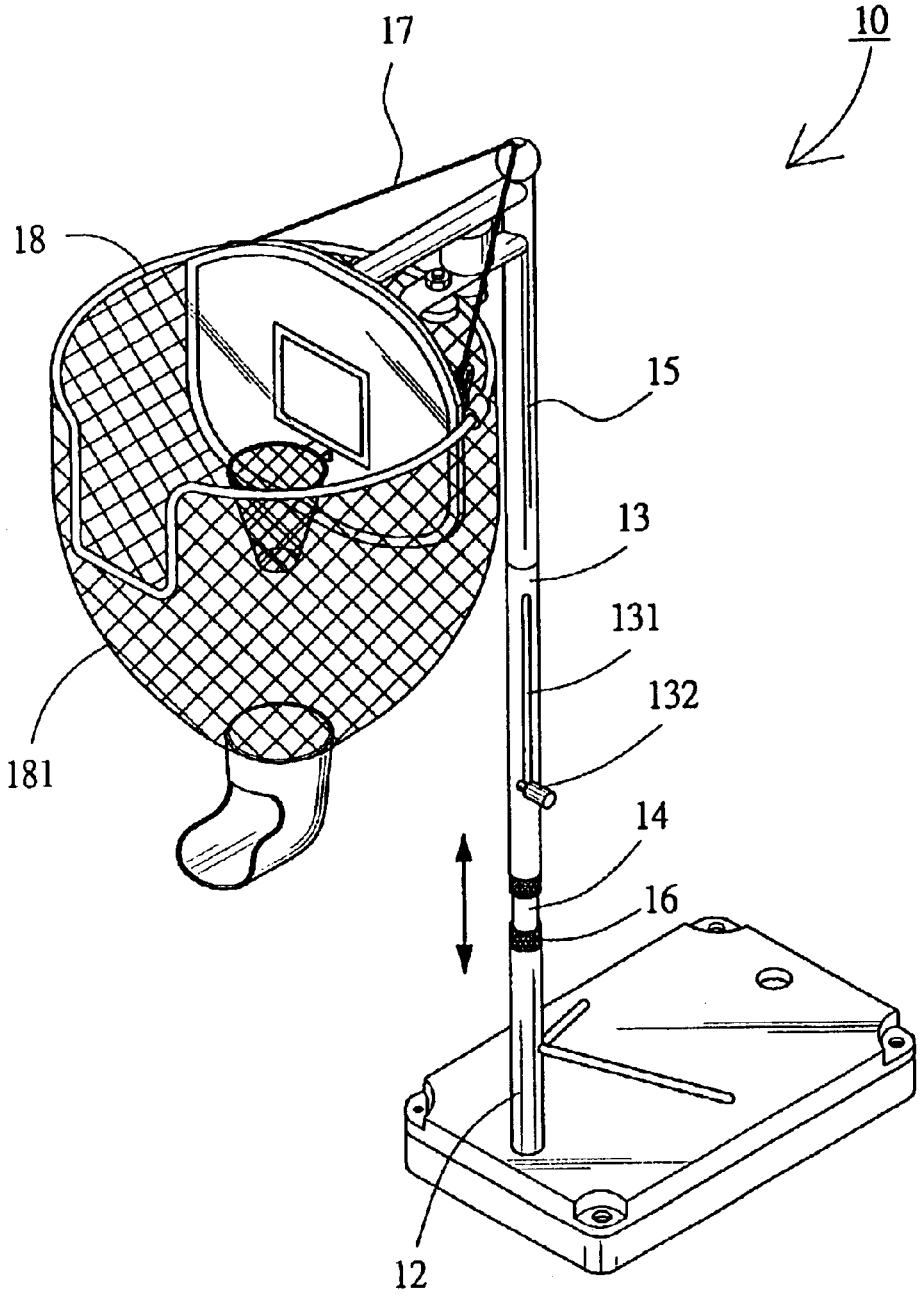
FIG. 3 is a schematic operational view of the basketball practicing and collecting device as shown in FIG. 1 in adjustment.

As shown in FIG. 3, the first snap ring 16 can be released to adjust the distance between the lift tube 14 and the first tube 12, so as to satisfy the user's requirement.

Figure 4:
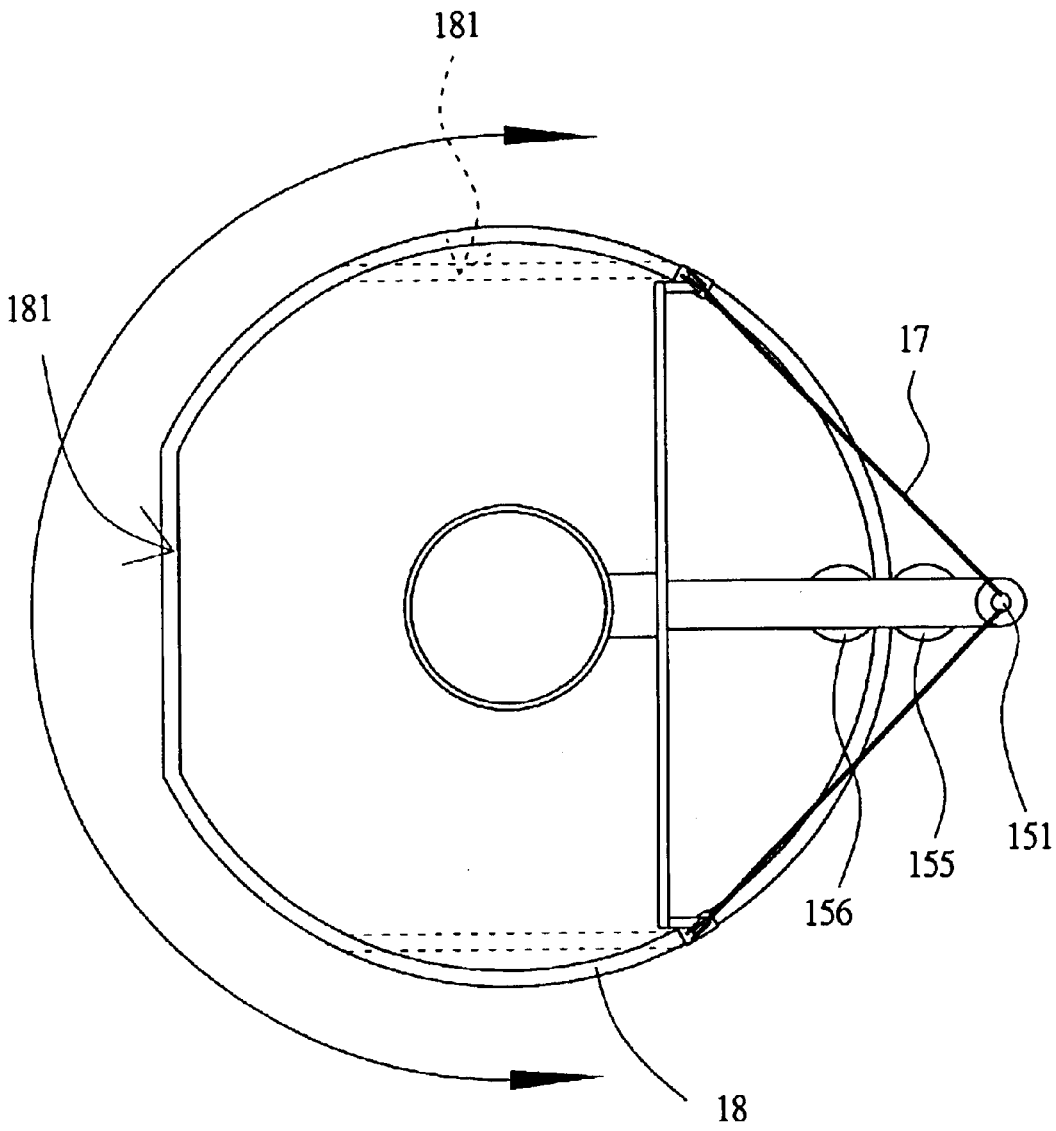
FIG. 4 is a schematic top plan operational view of the basketball practicing and collecting device as shown in FIG. 1 in use.

As shown in FIG. 4, the drive roller 155 is rotated by the reduction motor 154, and the frame tube 18 is held and urged between the drive roller 155 and the driven roller 156, so that the frame tube 18 is turned horizontally by rotation of the drive roller 155 and the driven roller 156, so as to change the position of the ball inlet opening 181 of the frame tube 18, thereby facilitating the user practicing the free throw in a determined direction.

Figure 5:
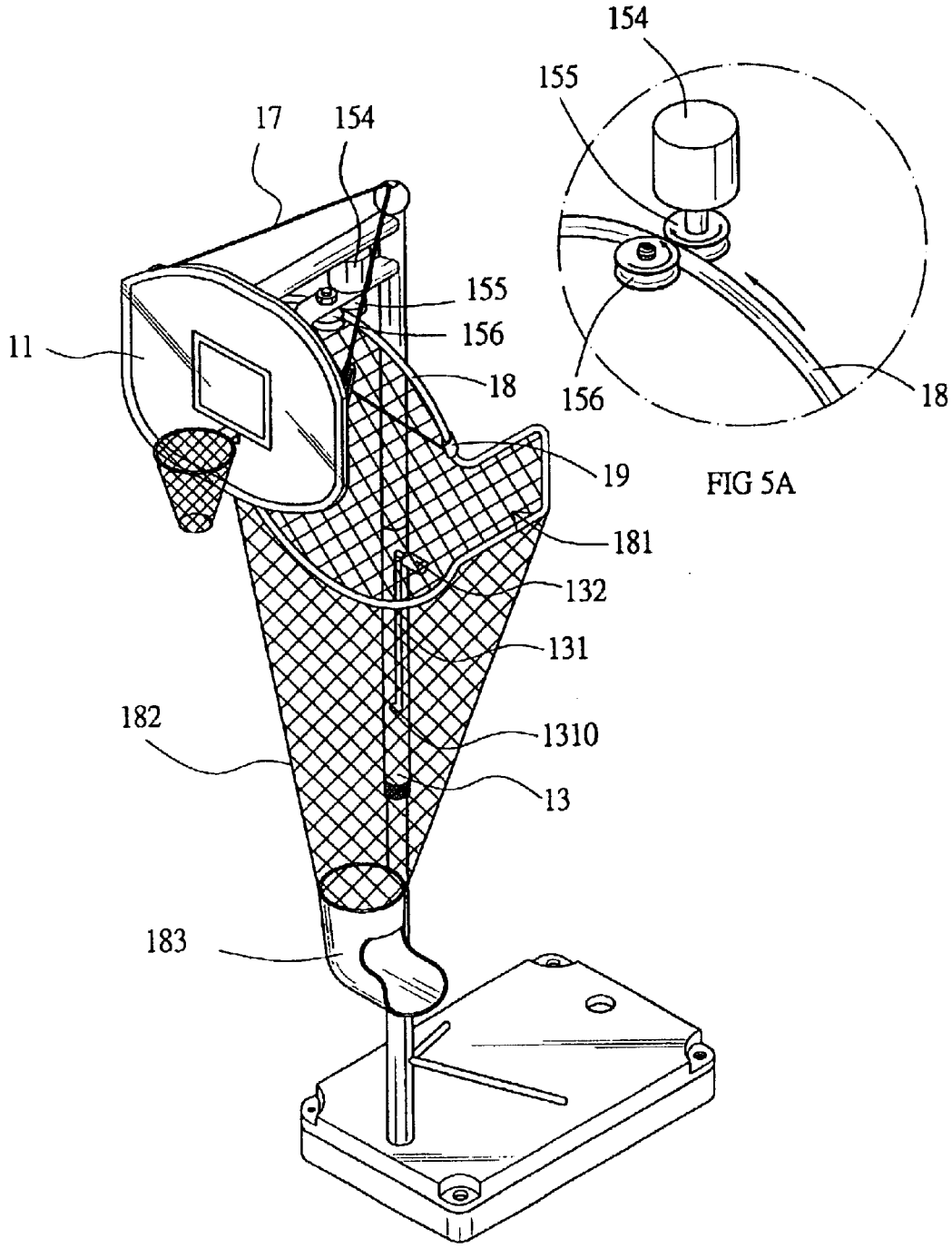
FIG. 5 is a schematic folded view of the basketball practicing and collecting device as shown in FIG. 1 when not in use.

As shown in FIGS. 5 and 5A, the pull handle 132 is detached from the locking recess 1310, so that the pull handle 132 can be moved upward in the guide slot 131 of the second tube 13 until the pull handle 132 is stopped by the top end of the guide slot 131 of the second tube 13. At the same time, the pull cord 17 is moved upward by the pull handle 132 to loosen and release the two opposite slide seats 19, so that the frame tube 18 is pivoted downward, thereby detaching the frame tube 18 from the backboard 11.

At this time, the drive roller 155 is rotated by the reduction motor 154, and the frame tube 18 is held and urged between the drive roller 155 and the driven roller 156, so that the frame tube 18 is turned horizontally by rotation of the drive roller 155 and the driven roller 156 and is moved to the backside the backboard 11, thereby returning the basketball rack to the original normal state.

Figures 6, 6A:
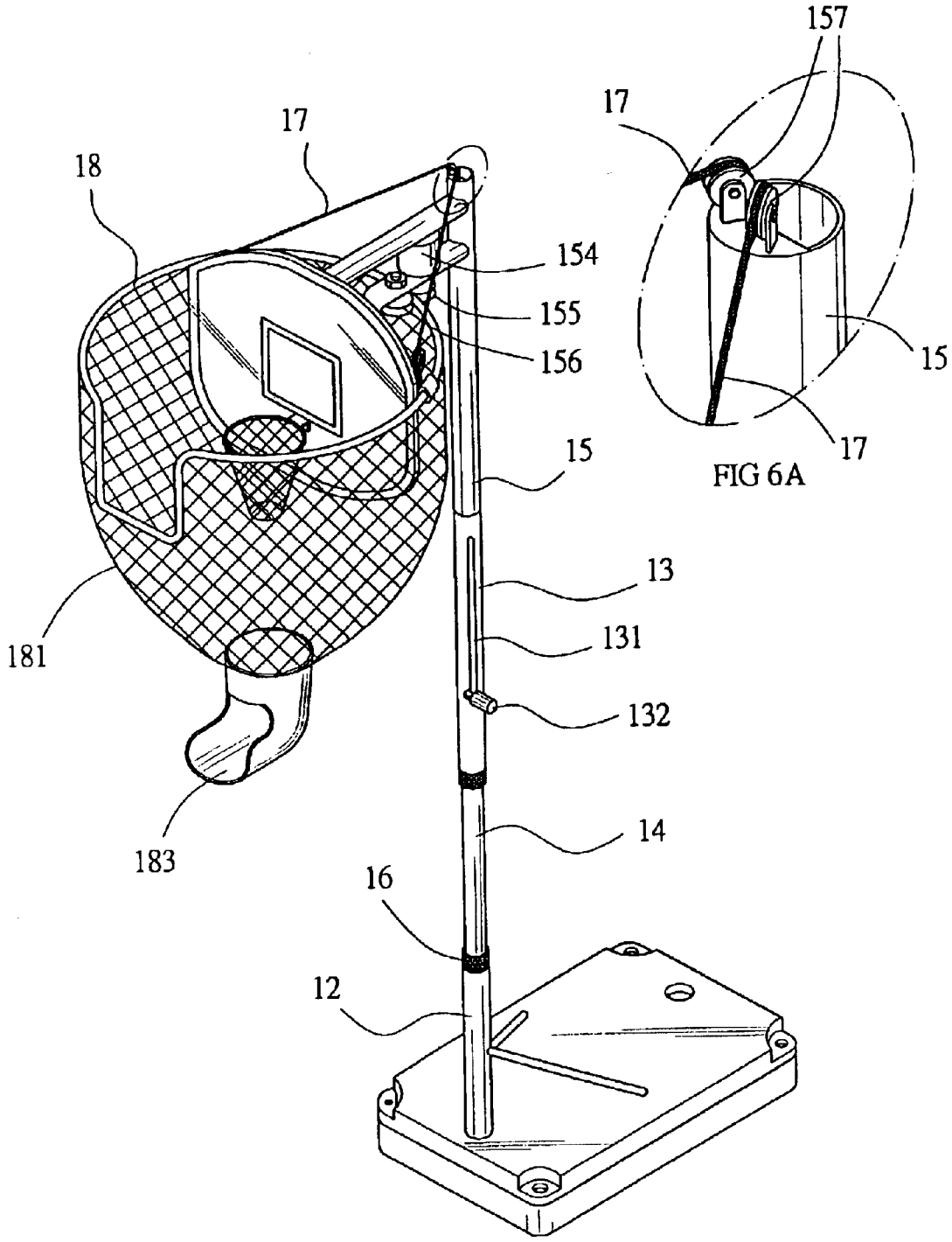
FIG. 6 is a perspective view of a basketball practicing and collecting device in accordance with another embodiment of the present invention.
FIG. 6A is a partially enlarged view of the basketball practicing and collecting device as shown in FIG. 6.

Referring to FIGS. 6 and 6A, the basketball practicing and collecting device in accordance with another embodiment of the present invention is shown, wherein the top end of the third tube 15 is provided with two opposite pulley members 157 for mounting the two ends of the pull cord 17, thereby facilitating movement of the two ends of the pull cord 17.

Figure 7:
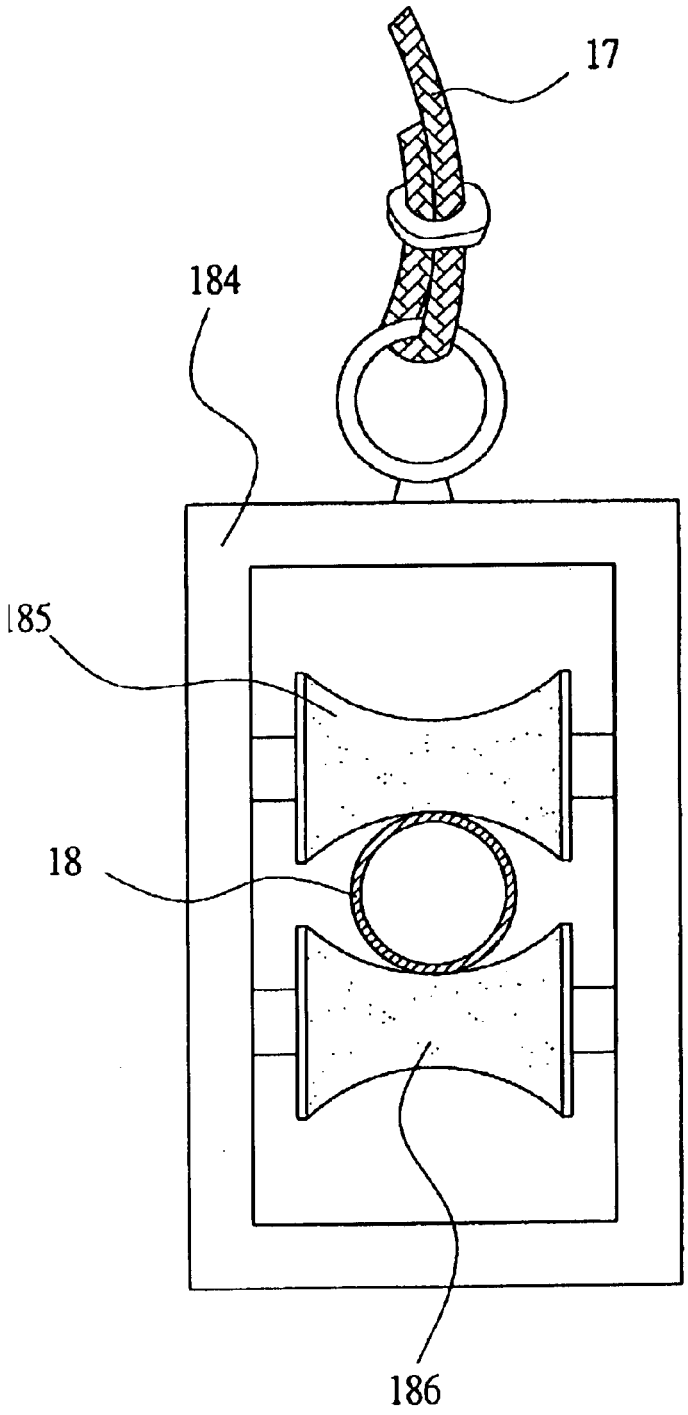
FIG. 7 is a side plan cross-sectional view of a basketball practicing and collecting device in accordance with another embodiment of the present invention.

Referring to FIG. 7, the basketball practicing and collecting device in accordance with another embodiment of the present invention is shown, wherein each of the two opposite slide seats 184 is mounted on the frame tube 18 and is provided with an upper wheel 185 made of rubber and a lower wheel 186 made of rubber, with the frame tube 18 being sandwiched between the upper wheel 185 and the lower wheel 186, so as to decrease the sliding friction of the frame tube 18, thereby increasing the lifetime of the frame tube 18.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A basketball practicing and collecting device, comprising a base, a first tube, a lift tube, a second tube, and a third tube, wherein:

the first tube has a lower end secured on the base;

the lift tube has a lower end retractably mounted on an upper end of the first tube;

the second tube has a lower end retractably mounted on an upper end of the lift tube;

the third tube has a lower end mounted on an upper end of the second tube;

the basketball practicing and collecting device further comprises a lower support rack having a first end secured on an upper end of the third tube and a second end secured on a lower end of the backside of the backboard;

the basketball practicing and collecting device further comprises a reduction motor secured on the lower support rack, a drive roller mounted on and rotated by the reduction motor, a driven roller secured on the lower support rack and located adjacent to the drive roller, and a frame tube urged between the drive roller and the driven roller;

the second tube is formed with an elongated guide slot, the guide slot of the second tube has a lower end formed with a locking recess vertical to the guide slot;

the third tube has a top formed with a slide hole; and the basketball practicing and collecting device further comprises two opposite pulley members each secured on the upper end of the backside of the backboard, two opposite slide seats each mounted on the frame tube, a pull handle slidably mounted in the guide slot of the second tube, and a pull cord secured on the pull handle and having two ends each extended through the second tube, the third tube, the slide hole and a respective one of the two opposite pulley members, and each secured on a respective one of the two opposite slide seats.

2. The basketball practicing and collecting device in accordance with claim 1, wherein the lower end of the lift tube is mounted on the upper end of the first tube by a first snap ring.

3. The basketball practicing and collecting device in accordance with claim 1, wherein the lower end of the second tube is mounted on the upper end of the lift tube by a second snap ring.

4. The basketball practicing and collecting device in accordance with claim 1, further comprising an upper support rack having a first end secured on the upper end of the third tube and a second end secured on the upper end of the backside of the backboard.

5. The basketball practicing and collecting device in accordance with claim 1, wherein the drive roller is made of rubber.

6. The basketball practicing and collecting device in accordance with claim 1, wherein the driven roller is made of rubber.

7. The basketball practicing and collecting device in accordance with claim 1, wherein when the pull handle is moved downward in the guide slot of the second tube and locked in the locking recess, the pull cord is pulled downward by the pull handle to pull the two opposite slide seats upward, thereby pivoting the frame tube upward, so as to stretch the frame tube, so that the backboard is compassed in the frame tube.

8. The basketball practicing and collecting device in accordance with claim 1, wherein the drive roller is rotated by the reduction motor, and the frame tube is held and urged between the drive roller and the driven roller, so that the frame tube is turned horizontally by rotation of the drive roller and the driven roller.

9. The basketball practicing and collecting device in accordance with claim 1, wherein the frame tube is a ring-shaped tube.

10. The basketball practicing and collecting device in accordance with claim 1, wherein the frame tube has a side formed with a ball inlet opening.

11. The basketball practicing and collecting device in accordance with claim 1, wherein the frame tube has a lower portion provided with an elastic net encompassing the backboard.

12. The basketball practicing and collecting device in accordance with claim 11, wherein the elastic net has a lower portion provided with a collection channel.

13. The basketball practicing and collecting device in accordance with claim 11, wherein the frame tube is provided with a plurality of net hooks for hanging the elastic net.

14. The basketball practicing and collecting device in accordance with claim 1, wherein when the pull handle is detached from the locking recess, the pull handle is moved upward in the guide slot of the second tube until the pull handle is stopped by the top end of the guide slot of the second tube, while the pull cord is moved upward by the pull handle to loosen and release the two opposite slide seats, so that the frame tube is pivoted downward, thereby detaching the frame tube from the backboard.

15. The basketball practicing and collecting device in accordance with claim 1, wherein the top end of the third tube is provided with two opposite pulley members for mounting the two ends of the pull cord.

16. The basketball practicing and collecting device in accordance with claim 1, wherein each of the two opposite slide seats is provided with an upper wheel and a lower wheel, with the frame tube being sandwiched between the upper wheel and the lower wheel.

17. The basketball practicing and collecting device in accordance with claim 16, wherein the upper wheel is made of rubber.

18. The basketball practicing and collecting device in accordance with claim 16, wherein the lower wheel is made of rubber.

* * * * *